US010053858B2

(12) United States Patent
Kopish et al.

(10) Patent No.: US 10,053,858 B2
(45) Date of Patent: Aug. 21, 2018

(54) DEMOUNTABLE WALL SYSTEM

(71) Applicant: Krueger International, Inc., Green Bay, WI (US)

(72) Inventors: Andrew J. Kopish, Green Bay, WI (US); Joseph D. Vanderlinden, DePere, WI (US); Nathan A. Quintal, DePere, WI (US); James M. Durand, DePere, WI (US); Robert M. Wittl, DePere, WI (US); Scott A. Bosman, Green Bay, WI (US); Timothy John LaFleur, Menasha, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 13/754,417

(22) Filed: Jan. 30, 2013

(65) Prior Publication Data

US 2013/0192141 A1 Aug. 1, 2013

Related U.S. Application Data

(60) Provisional application No. 61/593,370, filed on Feb. 1, 2012.

(51) Int. Cl.
*E04B 2/82* (2006.01)
*E04B 2/74* (2006.01)
(Continued)

(52) U.S. Cl.
CPC ..... *E04B 2/74* (2013.01); *E04F 21/1877* (2013.01); *E05D 15/063* (2013.01); *E05D 15/28* (2013.01); *E05Y 2900/132* (2013.01)

(58) Field of Classification Search
CPC ..... E06B 3/5864; E06B 3/585; E06B 3/5878; E06B 3/60; Y10T 403/7062; Y10T 403/7067
(Continued)

(56) References Cited

U.S. PATENT DOCUMENTS 3,140,565 A * 7/1964 Ward, Jr. ..... 52/97
3,453,790 A * 7/1969 Harris ..... E04B 2/821 52/126.3
(Continued)

FOREIGN PATENT DOCUMENTS

WO 2011/137530 A1 11/2011
WO 2014/039278 A2 3/2014

OTHER PUBLICATIONS

FARAM P650 Catalog, Jan. 2009.
(Continued)

*Primary Examiner* — Chi Q Nguyen
(74) *Attorney, Agent, or Firm* — Andrus Intellectual Property Law, LLP

(57) ABSTRACT

A demountable modular wall system including a series of individual glass panels that can be positioned adjacent to each other. Each of the individual glass panels is supported by a panel height adjustment mechanism that allows the height of each side of the glass panel to be adjusted. Each wall panel includes an upper trim section that is stationary relative to the movable glass panels. Each of the individual glass panels can include a stiffening channel to reinforce the vertical side edges of the glass panel. A vertical trim section can be attached to cover the panel joint between adjacent glass panels. A sliding door track can be attached to the top end of the wall panel to support a sliding door.

7 Claims, 7 Drawing Sheets

(51) Int. Cl.
*E04F 21/18* (2006.01)
*E05D 15/28* (2006.01)
*E05D 15/06* (2006.01)

(58) Field of Classification Search
USPC ... 52/235, 238.1, 239, 241, 242, 243, 243.1, 52/126.4, 308, 656.1, 204.1, 204.5, 656.5, 52/204.71, 206, 767, 204.65, 584.1, 52/800.1, 800.18; 403/374.3, 373
See application file for complete search history.

(56) References Cited

U.S. PATENT DOCUMENTS 3,593,475 A * 7/1971 LaGue ..... 52/241
3,653,156 A 4/1972 Horgan, Jr.
4,128,983 A * 12/1978 Matsubara ..... 52/779
4,407,101 A 10/1983 Propst et al.
4,418,506 A * 12/1983 Weber ..... E04B 2/967 52/204.593
4,453,346 A * 6/1984 Powell et al. ..... 49/404
4,555,880 A 12/1985 Gzym et al.
4,574,547 A * 3/1986 Menchetti ..... E06B 1/36 52/238.1
4,578,913 A * 4/1986 Eich ..... 52/206
4,667,450 A * 5/1987 Stefnik ..... E04B 2/7409 52/238.1
4,891,920 A * 1/1990 Pingston ..... 52/145
5,233,803 A * 8/1993 Bockmiller ..... 52/239
5,592,795 A * 1/1997 Rinehart ..... E04B 2/967 52/204.591
6,016,632 A * 1/2000 McGee et al. ..... 52/241
6,058,665 A * 5/2000 Halvorson et al. ..... 52/205
6,141,923 A * 11/2000 Habicht ..... E04B 1/943 52/232
6,397,533 B1 * 6/2002 Hornberger et al. ..... 52/239
6,658,805 B1 * 12/2003 Yu et al. ..... 52/239
6,820,388 B2 * 11/2004 Newhouse et al. ..... 52/223.7
6,988,344 B1 * 1/2006 Krueger ..... 52/464
7,568,311 B2 * 8/2009 Shivak et al. ..... 49/409
8,011,146 B2 * 9/2011 Krause ..... F41H 5/263 52/235
8,024,901 B2 9/2011 Gosling et al.
8,601,749 B2 12/2013 Von Hoyningen Huene et al.
8,613,168 B2 12/2013 Von Hoyningen Huene et al.
8,615,936 B2 12/2013 Von Hoyningen Huene et al.
9,234,345 B1 * 1/2016 O'Keeffe ..... E04B 1/944
2002/0121056 A1 * 9/2002 Von Hoyningen Huene et al. ..... 52/241
2003/0089057 A1 * 5/2003 Wiechecki et al. ..... 52/238.1
2004/0020137 A1 * 2/2004 Battey et al. ..... 52/36.1
2005/0284094 A1 * 12/2005 Long ..... E04B 2/7455 52/782.1
2006/0185250 A1 8/2006 Gosling et al.
2010/0293882 A1 * 11/2010 Labrecque ..... E04B 2/967 52/705
2011/0099929 A1 * 5/2011 Liegeois et al. ..... 52/241
2012/0317899 A1 12/2012 Von Hoyningen Huene et al.
2014/0157720 A1 6/2014 Von Hoyningen Huene et al.

OTHER PUBLICATIONS

Canadian Office Action dated Sep. 18, 2014.
Canadian Search Report for Canadian Patent Application No. 2,804,654 dated Mar. 18, 2015.

* cited by examiner

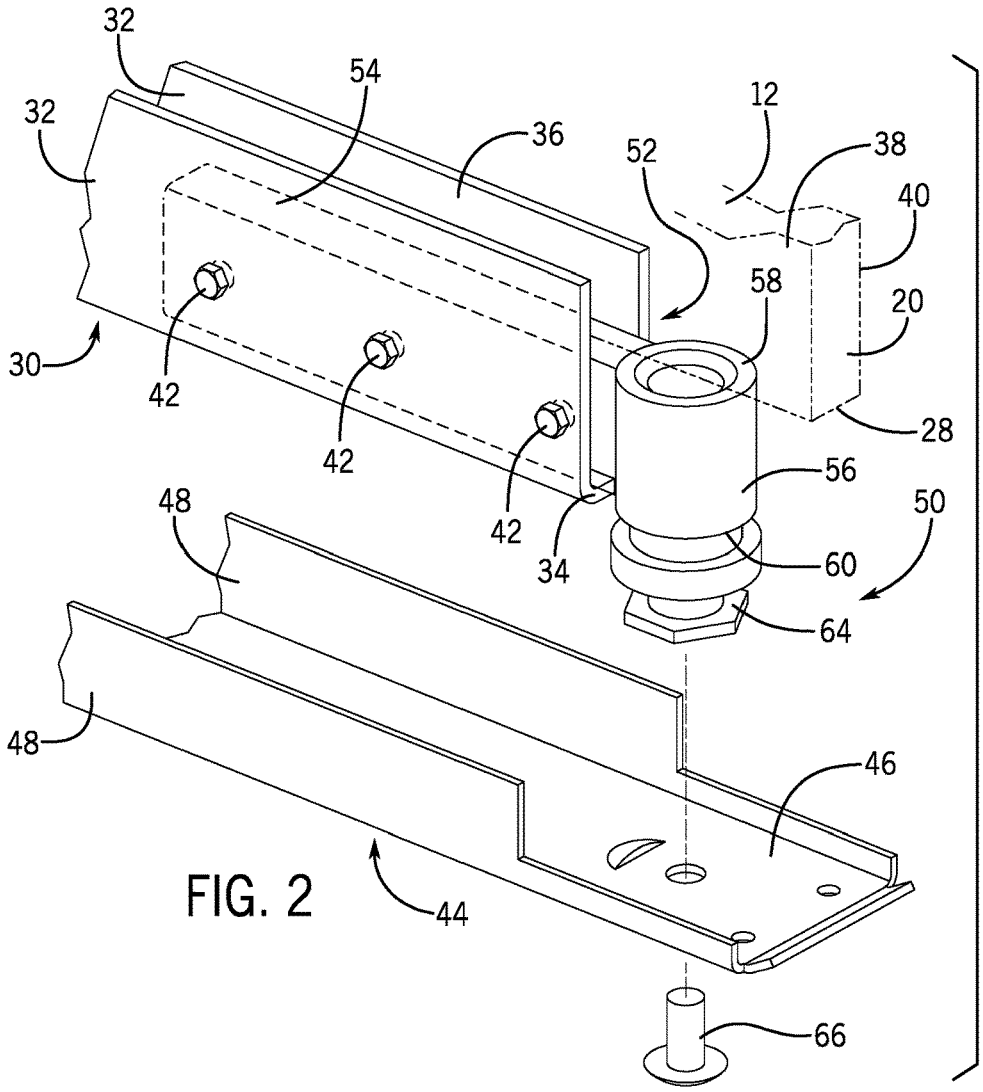
FIG. 2
FIG. 3
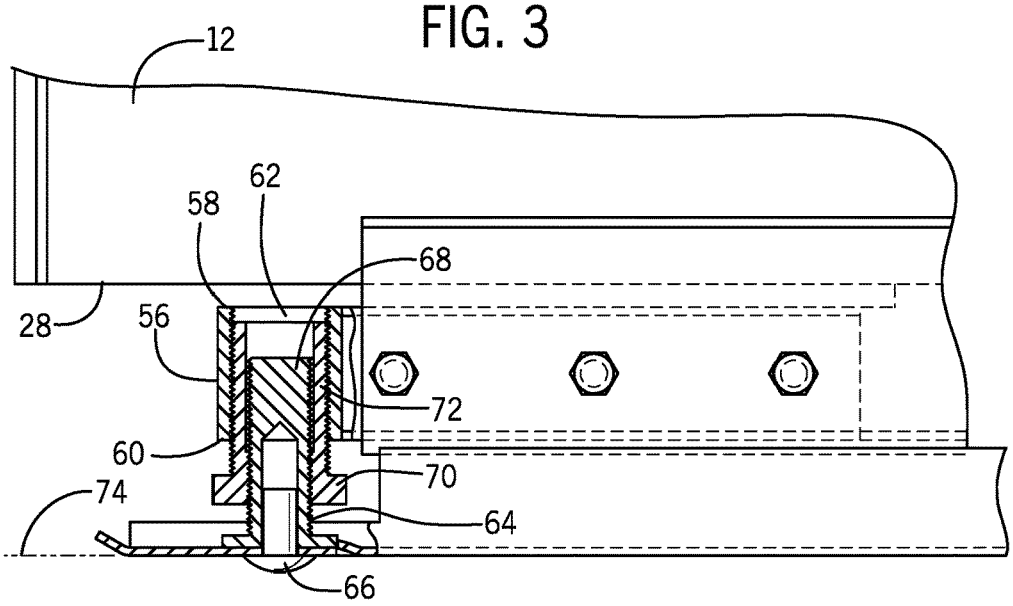

DEMOUNTABLE WALL SYSTEM

CROSS-REFERENCE TO RELATED APPLICATION

The present application is based on and claims priority to U.S. Provisional Patent Application Ser. No. 61/593,370 filed on Feb. 1, 2012.

BACKGROUND

The present disclosure generally relates to a wall panel system. More specifically, the present disclosure relates to a demountable wall system (DWS) that uses tempered or laminated glass as the primary exposed surface and the primary structural element.

Panel-type wall systems are commonly used to divide space in an open-plan office environment. In a typical modular panel-type wall system, a number of wall panels are interconnected together in a configuration suitable for the intended use of the space. Each wall panel typically includes a structural frame to which a pair of tiles are mounted. The tiles may be broadly classified as either decorative tiles or functional tiles. Decorative tiles have an acoustic insulating material covered by an appropriate finishing material such as fabric, metal or wood and are designed to provide sound proofing and aesthetic appearance. Functional tiles generally have a tile frame that supports functional components, such as a tool rail, one or more hooks, an opening, a window, a shelf, a marker board, paper management components, etc.

The large number of panel-type wall systems currently available allow a business owner to divide an open space into a series of enclosed areas. Although panel-type wall systems are commonly available, the solid surfaces used in most panel systems create an enclosed area that may not have any exterior windows or any other types of glass areas open to allow light to enter into the enclosed area.

Presently, modular wall systems have been developed that include glass panels as the structural elements rather than just as windows within a typical panel system. The demountable wall systems that use tempered or laminated glass as the primary exposed surface increase the amount of light that reaches into the enclosed area defined by the wall panel. However, utilizing glass panels instead of solid, structural panels creates certain challenges since structural components of the panel systems are viewable through the glass panel members.

SUMMARY

The present disclosure generally relates to a wall panel system that includes a series of glass wall panels that can be selectively oriented in a desired configuration. The demountable modular wall system includes a series of individual components that allow the wall panel system to be configured and reconfigured as desired.

The demountable modular wall system includes a series of individual glass panels that each have a top end, a bottom end and a pair of spaced side edges. Each of the individual glass panels is configured to extend between a floor and a ceiling of a building that is divided into areas or sections by the wall system.

Each of the individual glass panels includes a panel height adjustment mechanism that is positioned between the bottom end of each panel and the floor. Preferably, each of the individual glass panels includes a panel height adjustment mechanism positioned on each of the spaced sides of the wall panel. Each of the panel height adjustment mechanisms can be independently adjusted to adjust the orientation and height of the individual glass panels.

In one embodiment of the disclosure, the panel height adjustment mechanism includes a pair of double jack screws that are each located on opposite sides of the wall panel. The double jack screw includes a stationary threaded stud that is fixed to the floor and an upper jack screw that is received along the threaded stud. The upper jack screw includes a threaded outer surface that is received in a mounting bracket attached to the bottom end of the glass panel. The stud and the upper jack screw are threaded in opposite directions such that rotation of the upper jack screw forces separation between the bottom end of the wall panel and the floor with a total stroke that is greater than twice the height of the adjustment mechanism.

An upper trim is positioned between the top end of the glass panel and the ceiling such that when the panel height adjustment mechanism is adjusted, the wall panel floats within the stationary upper trim during movement of the wall panel to present a uniform, continuous appearance. The upper trim is mounted to a stationary ceiling channel and the top end of the glass panel moves relative to both the upper trim and the ceiling channel. A lower trim section is mounted to the floor channel and contacts the wall panel while allowing the wall panel to move relative to the stationary lower trim.

In one embodiment of the modular wall system, the modular wall system includes a sliding door that is movable between a pair of spaced wall panels. The sliding door is supported within a sliding door track that is mounted to the top trim section of the wall panel. The sliding door track includes at least one roller channel that receives rollers of a sliding door. The sliding door track allows the sliding door to move along the wall panels for opening and closing a doorway created by the panel system. The sliding door track includes at least one roller channel that is spaced from the glass panel when the sliding door track is mounted to the top trim section.

The demountable wall panel system can further include individual glass panels having a reduced thickness. In such an embodiment, a stiffening channel is mounted to at least the vertical side edges of each of the glass panels. The stiffening channels may be formed from various different types of metallic material, such as an extruded aluminum.

A mounting bracket is positioned along the panel joints to provide a point of connection for a vertical trim piece. Each of the mounting brackets includes an attachment portion that allows the vertical trim section to snap into place along the mounting bracket.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 2 is a magnified view of one of the panel height adjustment mechanisms used to adjust the height of the wall panel from a floor;

FIG. 3 is a partial section view of the panel height adjustment mechanism shown in FIG. 2;

DETAILED DESCRIPTION

Figure 1:
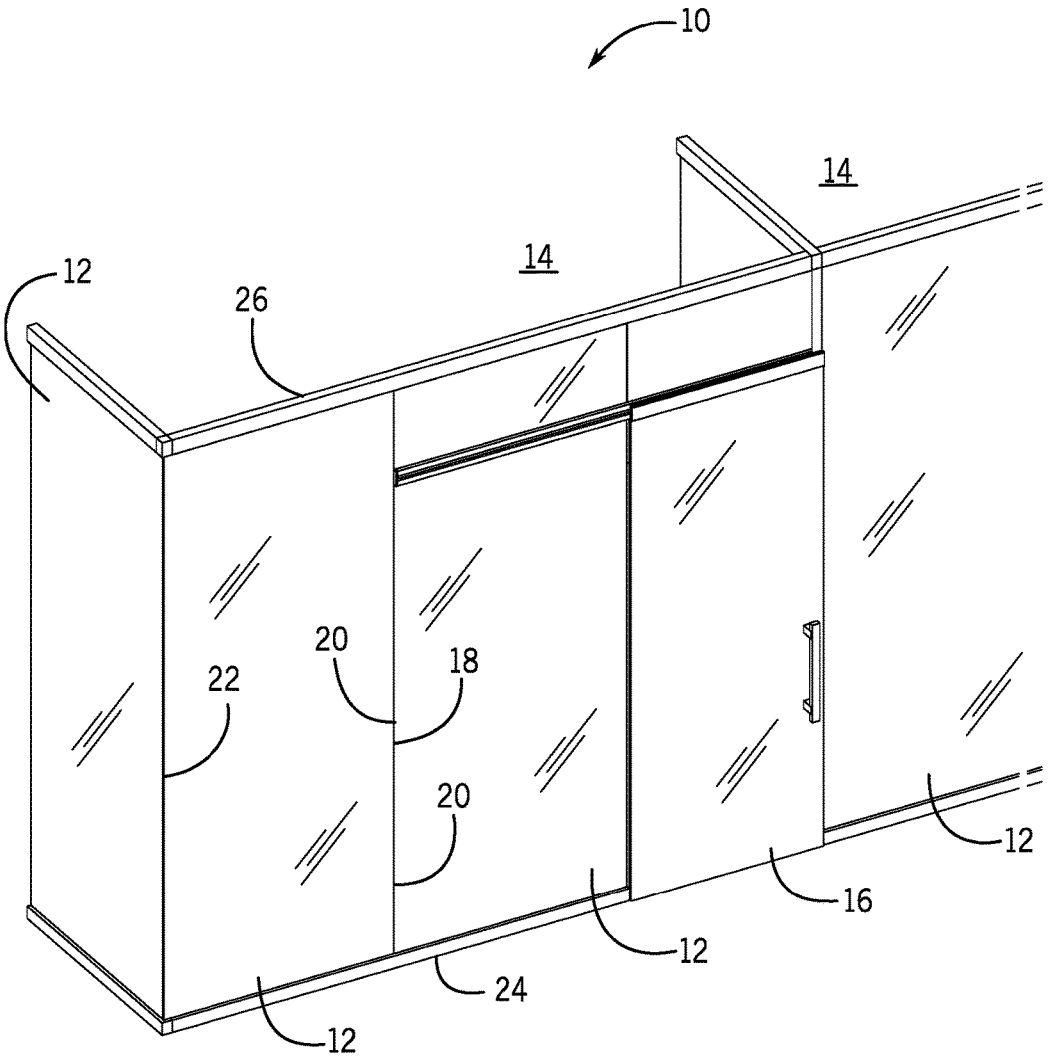
FIG. 1 is a perspective view of a demountable wall system of the present disclosure.

FIG. 1 illustrates a demountable wall system (DWS) 10 constructed in accordance with the present disclosure. The wall system 10 shown in FIG. 1 includes multiple glass panels 12 that can be used with conventional solid wall panels or with each other to create multiple rooms 14.

In the embodiment shown in FIG. 1, the wall system 10 includes a sliding door 16 that can be used to selectively expose a doorway to enter into one of the rooms 14. In the embodiment shown in FIG. 1, the adjacent wall panels 12 abut each other to create a panel joint 18. In the embodiment illustrated, the panel joint is a butt-glazed joint in which one of the side edges 20 of the adjacent wall panels 12 includes a bulb seal that creates a seal between the pair of adjacent wall panels at the panel joint 18. In addition, one of the pair of wall panels 12 that define the corner 22 also include a bulb seal to create the joint between the pair of walls positioned at a 90° angle relative to each other.

As illustrated in FIG. 1, the demountable wall system 10 includes a lower trim 24 and an upper trim 26 that enhance the overall aesthetic appearance of the demountable wall system 10. In the embodiment shown in FIG. 1, both the lower trim 24 and the upper trim 26 are continuous sections that extend across multiple glass wall panels 12. The upper and lower trim sections 24, 26 are installed after the construction of the demountable wall system and provide a visually appealing appearance for the wall system 10.

Referring now to FIG. 2, each of the glass wall panels 12 includes a bottom end 28 and a pair of side edges 20, only one of which is shown in FIG. 2. The bottom end 28 of each wall panel 12 is received within a bottom rail 30. The bottom rail 30 includes a pair of vertical support flanges 32 that are joined to each other by a bottom wall 34 to define an open receiving cavity 36 sized to receive the glass wall panel 12. The support flanges 32 contact one of the two face surfaces 38, 40 of the glass wall panel 12. In the embodiment shown in FIG. 2, the bottom rail 30 is clamped onto the bottom end 28 of the glass wall panel 12 through a series of fasteners As illustrated in FIG. 2, a floor channel 44 is used as part of the demountable wall system 10 and is securely attached to the floor of a building. The floor channel 44 includes a generally flat base 46 and a pair of upstanding sidewalls 48. The floor channel 44 is mounted to the floor of a building and provides a secure point of attachment and stability for the individual glass panels 12. The floor channel 44 is a continuous component that extends beneath a single wall panel. A series of floor channels can be connected together to generally define the configuration of the walls to be constructed utilizing the multiple glass panels.

Since the floor of a building may not be level, the wall panel system of the present disclosure includes a series of panel height adjustment mechanisms 50 that allow the height of each of the glass wall panels 12 to be independently adjusted to create an even wall. A panel height adjustment mechanism 50 is positioned at each side of the wall panel such that the opposite sides of the wall panel can be independently adjusted to compensate for an uneven floor. Each of the panel height adjustment mechanisms 50 includes a mounting bracket 52 that is securely held within the bottom rail 30 by the series of fasteners 42. The mounting bracket 52 includes an attachment bar 54 attached to a receiving cylinder 56. The receiving cylinder 56 extends between a top end 58 and a bottom end 60. As best shown in FIG. 3, the receiving cylinder 56 includes an internally threaded open interior 62.

The panel height adjustment mechanism 50 shown in FIG. 2 is essentially a double jack screw that allows the overall height of the wall panel 12 to be adjusted while minimizing the fully retracted sides of the adjustment mechanism 50. The double jack screw includes a stud 64 that is stationary and attached to the floor channel 44 by fastener 66. As illustrated in FIG. 3, the fastener 66 prevents the stud 64 from rotating. The stud 64 includes a shaft 68 having external threads. The external threads of the shaft 68 are received within an internally threaded open interior of an upper jack screw 70. The upper jack screw 70 also includes an externally threaded shaft 72 that is threaded in the opposite hand from the stud 64. The shaft 72 is received by the internally threaded open interior 62 of the receiving cylinder 56.

As can be understood in FIG. 3, the height of the bottom end 28 of the wall panel 12 above the floor 74 can be modified by rotating the upper jack screw 70. Because the threads on the stud 64 and the upper jack screw 70 are opposite handed, rotation of the upper jack screw 70 results in both the movement of the upper jack screw 70 along the shaft 68 of the threaded stud 64 and the movement of the receiving cylinder 56 along the shaft 72 of the upper jack screw 70. This double threaded arrangement of the panel height adjustment mechanism 50 creates a total stroke that is greater than twice the height of the adjustment mechanism when completely retracted. This configuration allows for a greater range of motion while minimizing the size of the panel height adjustment mechanism 50.

Figure 4:
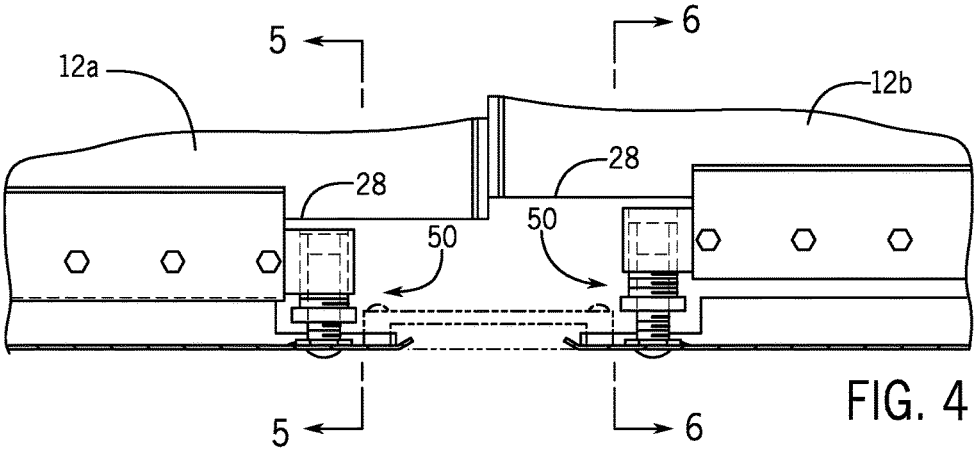
FIG. 4 is a schematic illustration of the adjustment of adjacent panels through utilization of the panel height adjustment mechanism.

FIG. 4 illustrates the independent adjustment of a first wall panel 12*a* relative to a second wall panel 12*b*. The independent adjustment between the two wall panels 12*a*, 12*b* allows the demountable wall system of the present disclosure to be independently adjusted when the floor of a building is not level. In the embodiment shown in FIG. 4, the bottom edges 28 of the adjacent wall panels 12*a*, 12*b* do not align with each other after each of the pair of panel adjustment mechanisms 50 have been adjusted.

Figure 5:
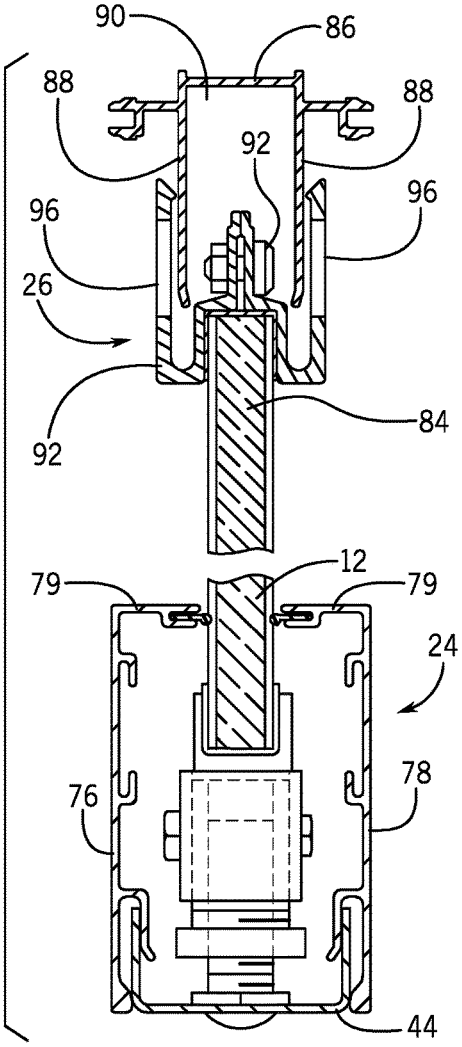
FIG. 5 is a section view taken along line 5-5 of FIG. 4.
Figure 6:
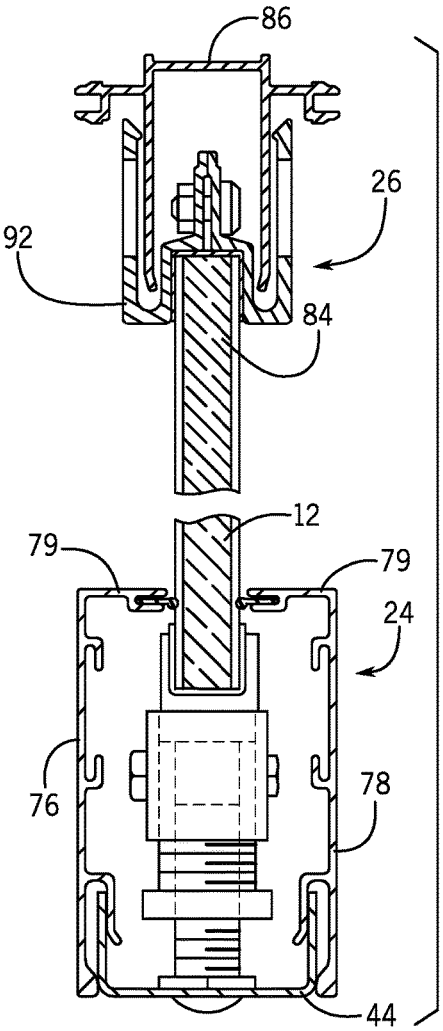
FIG. 6 is a section view taken along line 6-6 of FIG. 4.

As is illustrated in FIGS. 5 and 6, the lower trim 24 and the upper trim 26 create an overall smooth appearance for the trim sections. As illustrated in FIGS. 5 and 6, the lower trim 24 includes a first section 76 and a second section 78 that are each stationary and mounted to the floor channel 44. Each of the first and second sections 76, 78 includes a horizontal flange 79 that supports wiper 77 that contacts one of the faces of the wall panel 12.

Since the lower trim 24 covers the panel height adjustment mechanism 50, the panel height adjustment mechanism 50 is used to adjust the height of each of the panels 12 prior to the attachment of the lower trim 24.

In addition to the lower trim 24, each of the wall panels includes an upper trim 26 that also allows for movement of the top end 84 of the glass wall panel 12 relative to the stationary top trim 26. As shown in FIG. 5, a ceiling channel 86 is securely mounted to the ceiling of the building. The ceiling channel 86 may be mounted to the ceiling of a building utilizing various different attachment techniques, such as screws or other types of fasteners. The ceiling channel 86 is thus stationary relative to the adjustable glass wall panel 12. The ceiling channel 86 includes a pair of depending flanges 88. The flanges 88 are spaced by an open passageway 90 that can receive a portion of the top end 84 of the wall panel 12 during the adjustment of the wall panel 12.

The wall panel 12 further includes a top guide channel 92 that is securely attached to the top end 84 of the wall panel 12 utilizing various different types of attachment techniques. In the embodiment shown, a fastener 94 is used to clamp the top guide channel 92 in place. A flexible material or adhesive can be positioned between the top guide channel 92 and the top end 84 to further aid in attachment of the top guide channel 92 to the wall panel 12. The top guide channel 92 includes a pair of vertically extending side arms 96 that each move along the vertical flanges 88 of the ceiling channel 86. As can be understood in the comparison of FIGS. 5 and 6, the movement of the side arms 96 along the flanges 88 allow for vertical movement of the wall panel 12 while preventing separation of the panel from the ceiling channel 86.

As illustrated in FIG. 5, the upper trim 26 is attached to the stationary ceiling channel 86 to cover both the ceiling channel 86 and the moving top guide channel 92. The upper trim 26 includes a top wall 160 and a flange 162 that combine to receive and entrap a resilient mounting member 164. The mounting member 164 is supported along a support extrusion 166 that is spaced away from the vertical flange 88 of the ceiling channel 86 by a support arm 167. The combination of the top wall 160 and the flange 162 securely support the top trim 26, as illustrated.

Sidewall 168 of the top trim extends downward past the top guide channel 92 and is joined to a bottom wall 170. The bottom wall 170 extends horizontally and includes an open end 172 that receives and supports a resilient wiper 174. The wiper 174 contacts the outer face of the glass wall panel 12. As can be understood in FIGS. 5 and 6, as the height of the glass wall panel 12 is adjusted, the wiper 174 moves along the wall panel 12 since the upper trim 26 is stationary. In this manner, the wall panel 12 floats within the upper trim 26. In the preferred embodiment disclosed in FIGS. 5 and 6, the upper trim 26 is formed from an extruded metal material, such as aluminum.

Figure 7:
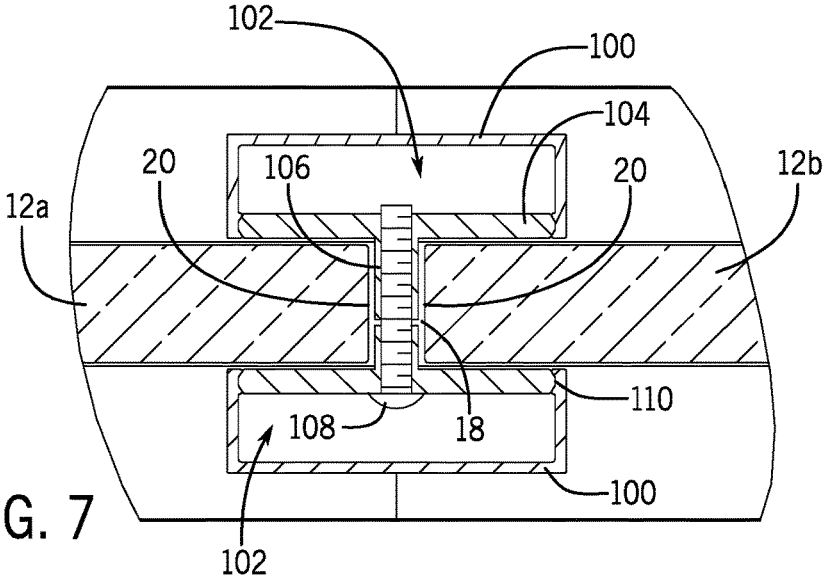
FIG. 7 is a section view illustrating one type of vertical trim attachment between adjacent glass wall panels.

FIG. 7 illustrates a first embodiment for attaching a section of vertical trim between adjacent glass wall panels 12*a* and 12*b*. As illustrated in FIG. 7, the side edges 20 of the adjacent wall panels 12*a*, 12*b* define a panel joint. As illustrated in FIG. 7, a vertical trim section 100 can be positioned on both sides of each of the glass wall panels 12*a*, 12*b* to cover the panel joint 18. In the embodiment shown in FIG. 7, a mounting bracket 102 is positioned on each side of the panel joint 18. Each of the mounting brackets 102 includes an attachment flange 104 and a center section 106. The center sections 106 extend into the panel joint 18 and includes a series of internal threads. The internal threads of each center section 106 receive a fastener 108. The fastener 108 is used to secure the pair of mounting brackets 102 on opposite sides of the wall panels 12*a*, 12*b*.

The outer edge of the attachment flange 104 for each of the mounting brackets 102 includes an attachment area 110. The attachment area 110 allows the vertical trim section 100 to snap into place along the mounting brackets, as illustrated. Several mounting brackets can be positioned along the height of the wall panels to provide spaced points of attachment for the vertical trim 100. The frictional fit between the vertical trim section 100 and the mounting bracket 102 allows the vertical trim section 100 to be easily positioned to cover the panel joint 18.

In the embodiment shown in FIG. 7, each of the wall panels 12*a*, 12*b* has a thickness of approximately ½ inch. Based upon this thickness of the glass wall panel 12*a*, 12*b*, the vertical trim sections 100 simply cover the panel joint.

Figure 8:
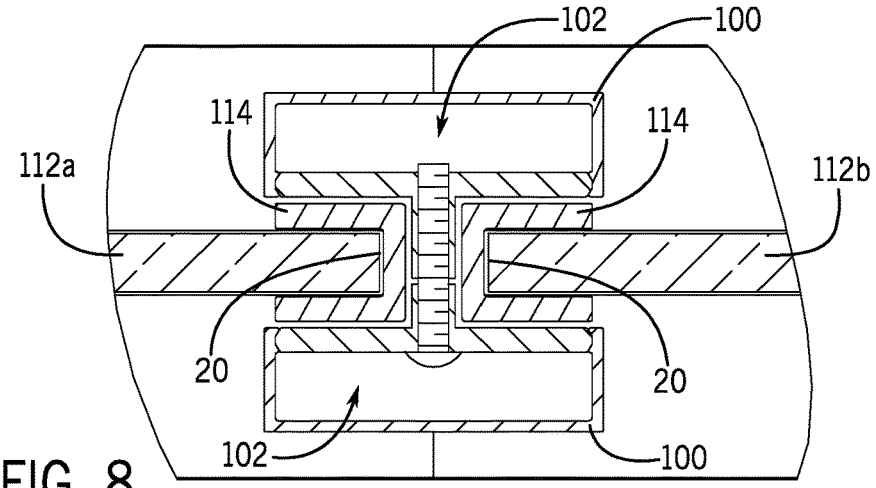
FIG. 8 is a section view illustrating the use of panel stiffening members between adjacent glass panels.

However, it is contemplated that the wall panel system could be utilized including wall panels 112*a* and 112*b* that have a reduced thickness, such as shown in FIG. 8. In FIG. 8, each of the wall panels 112*a*, 112*b* have a thickness of only ¼ inch thick glass. The use of thinner glass results in a cost savings but results in a glass panel that is typically not stiff enough to provide the required resistance to bending to transverse loads.

In the embodiment shown in FIG. 8, a stiffening channel 114 is attached to each of the vertical side edges 20 of the respective wall panel 12*a*, 12*b*. The stiffening channels 114 are connected only to the vertical side edges of the glass panels 112 to provide additional vertical strength for the thin wall panels 112*a*, 112*b*.

In the embodiment illustrated, each of the stiffening channels 114 is formed from a metallic material, such as steel or extruded aluminum.

Once the stiffening channels 114 are attached to each of the wall panels 112*a*, 112*b*, the mounting brackets 102 are used to provide a point of attachment for the vertical trim sections 100, as was the case in the embodiment of FIG. 7. Thus, the use of the stiffening channels 114 allow for the use of wall panels 112*a* and 112*b* that have a reduced thickness as compared to the embodiment shown in FIG. 7.

Figure 9:
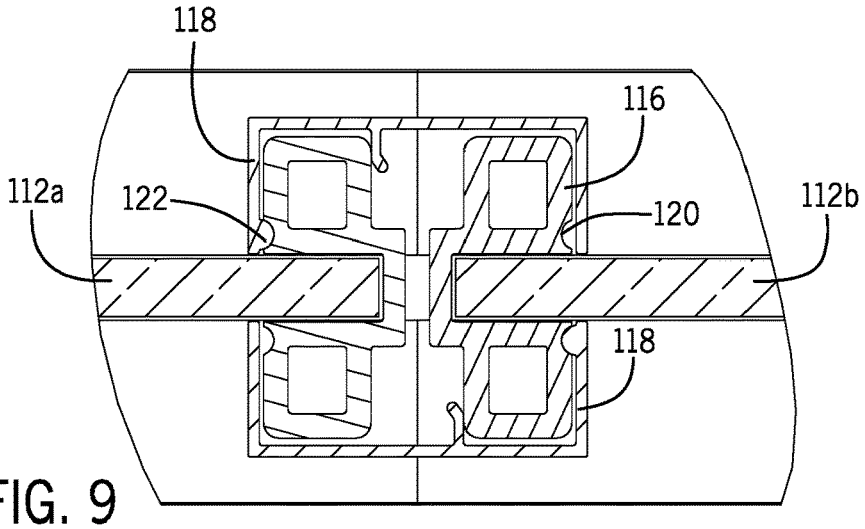
FIG. 9 is a section view illustrating another tile stiffening arrangement between glass panels.

FIG. 9 illustrates yet another embodiment of a stiffening channel that can be used. In the embodiment of FIG. 9, the stiffening channels 116 are each attached to one of the wall panels 112*a*, 112*b* to provide a point of attachment for the vertical trim section 118. In the embodiment shown in FIG. 9, each of the stiffening channels 116 includes a notch 120 that can receive a protruding bulb 122 to allow the trim section 118 to snap into place. The embodiment of FIG. 9 eliminates the requirement to utilize a separate mounting bracket, as in the embodiment shown in FIGS. 7 and 8. In both of the embodiments shown in FIGS. 8 and 9, the stiffening channels 114, 116 provide additional strength and rigidity for the ¼ inch glass wall panels 112.

Figure 10:
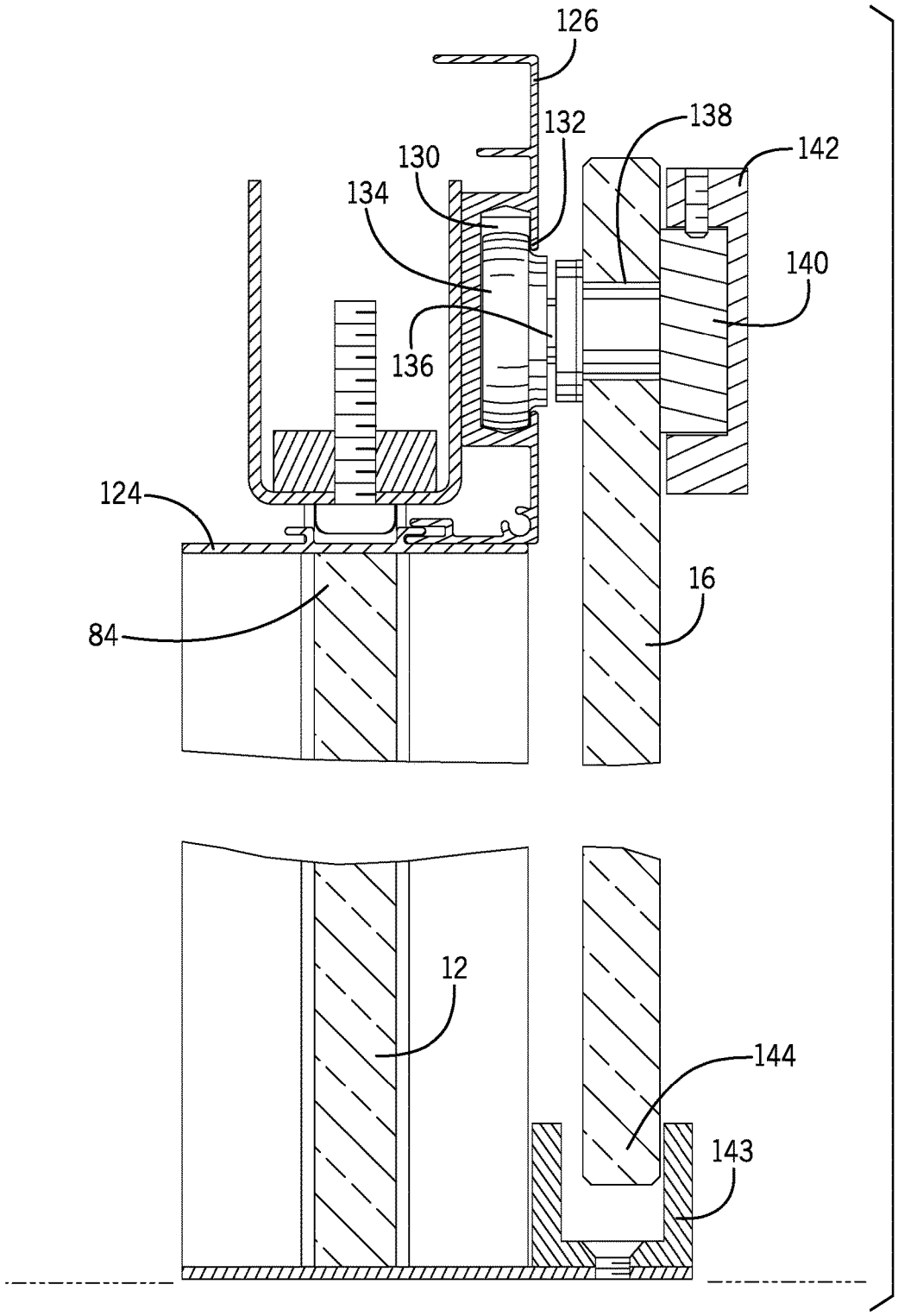
FIG. 10 is a section view illustrating the attachment of a sliding door track to the top trim section.

As stated in the description of FIG. 1, the demountable wall system 10 of the present disclosure can include a sliding door in addition to typical doors that mount on a pivot assembly. FIG. 10 illustrates one embodiment of mounting the sliding door 16 to cover an opening between two adjacent glass wall panels. As illustrated in FIG. 10, the top end 84 of the wall panel 12 includes a sliding door header 124 that extends between a pair of the wall panels 12. The sliding door header 124 receives and supports a sliding door track 126. The sliding door track 126 rests on the header 124 and is interlocked through an attachment slot 128. The sliding door track 126 defines a roller channel 130 that extends along the entire length of the sliding door track 126. Preferably, the sliding door track 126 extends both across the opening between adjacent wall panels as well as along one of the two adjacent panels to support the sliding door 16 in its open position. The roller channel 130 has an overall height that is greater than an opening 132 to the roller channel. The smaller opening 132 allows the roller channel 130 to entrap a series of rollers 134 within the roller channel 130.

As illustrated in FIG. 10, the roller 130 is supported along a shaft 136 which passes through an opening 138 formed near the top end of the sliding door 16. The shaft 136 is held within the opening 138 by an attachment member 140, which is surrounded by a trim piece 142. In the preferred embodiment of the disclosure, the sliding door track 126 is formed from an extruded metal, such as aluminum. The extruded metal sliding door track 126 allows the sliding door 16 to move between open and closed positions relative to the stationary wall panel.

As illustrated in FIG. 10, a lower door track 143 can be mounted to the floor to help retain and guide the bottom end 144.

Figure 11:
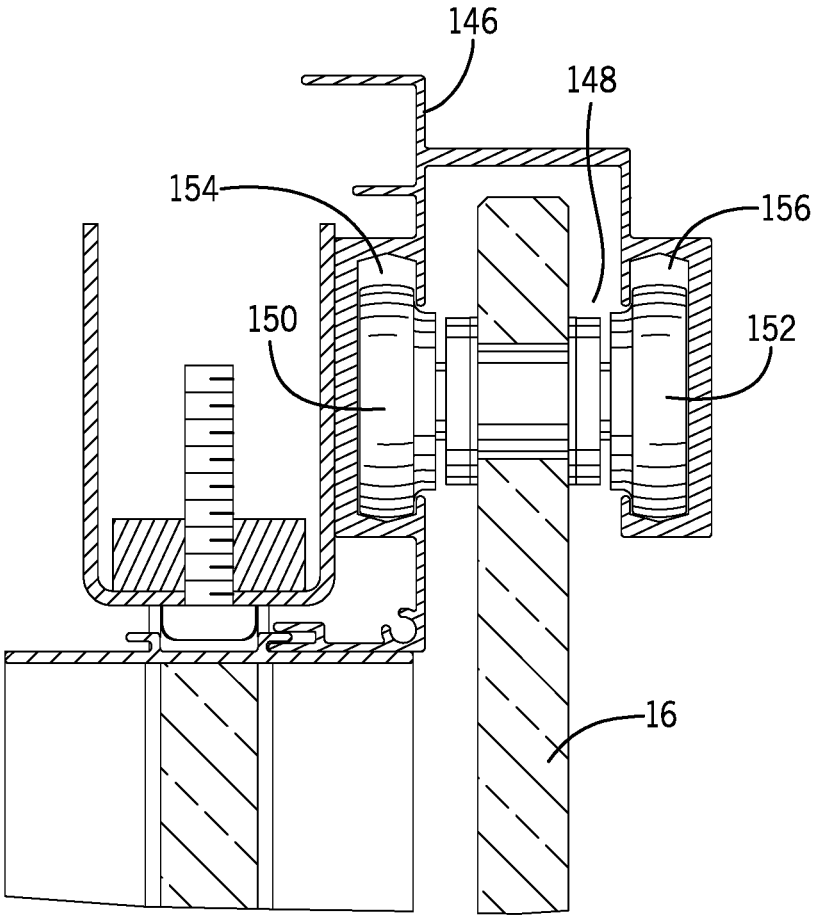
FIG. 11 is another view of an alternate embodiment of a sliding door track.

FIG. 11 illustrates another, alternate embodiment of the sliding door track 146. In the embodiment shown in FIG. 11, the sliding door 16 includes a trolley 148 that includes a pair of rollers 150 and 152. The pair of rollers are each received within a separate roller channel 154, 156, respectively. As with the embodiment shown in FIG. 10, the sliding door track 126 is formed from an extruded metal material, such as aluminum.

Although the siding door shown in FIG. 1 does not extend to the full height of the wall panel, it is contemplated that sliding doors could be utilized that extends the full height of the wall panel 12. The reduced height sliding door 16 and the full height door (not shown) are supported by a similar sliding door track to allow the door to move between open and closed positions.

Figure 12:
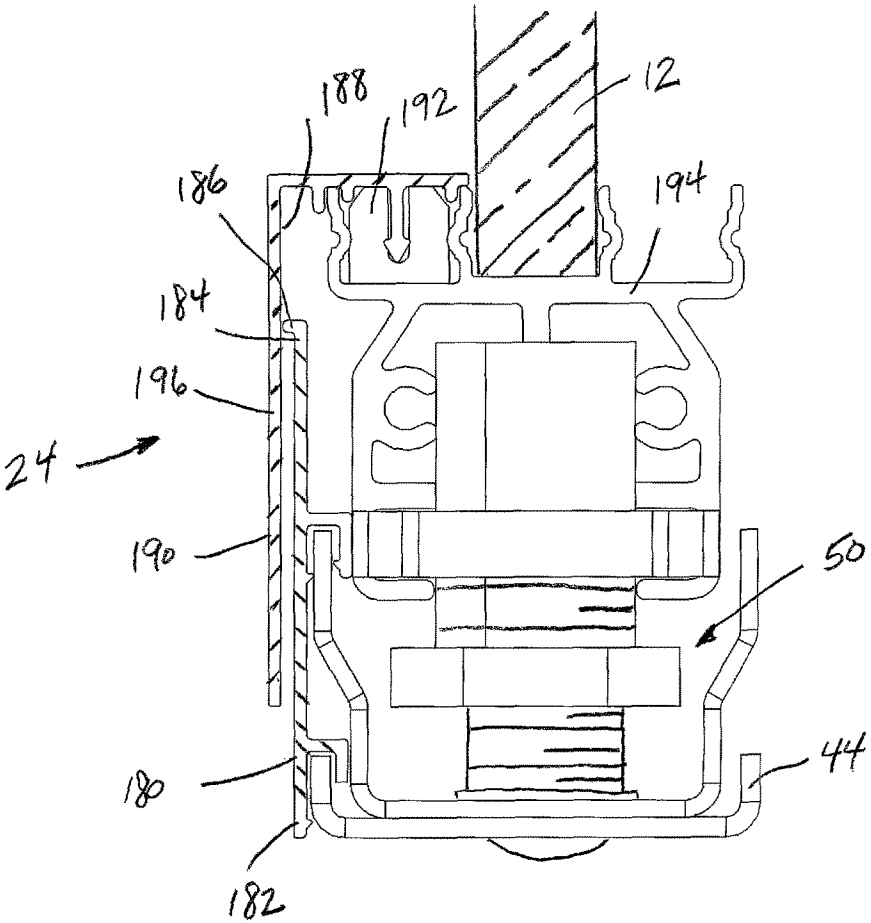
FIG. 12 is a section view of an alternate embodiment of the lower trim section.

FIGS. 5 and 6 illustrate one embodiment of the lower trim 24 that is mounted to conceal the height adjustment mechanism and provide a smooth interface with the moving glass panel 12. FIG. 12 illustrates another embodiment of the lower trim 24. In the embodiment shown in FIG. 12, the bottom trim 24 includes a lower trim section 180 secured to the floor channel 44. The lower trim section 180 extends between a lower end 182 and an upper end 184. The upper end 184 includes a protrusion 186 that contacts an inside surface 188 of an upper trim section 190. The upper trim section 190 is received within a support block 192. The support block 192 in turn is received within a mounting block 194 attached to the lower end of the wall panel 12. The mounting block 194 moves along with the glass wall panel 12 during adjustment of the height adjustment assembly 50. The vertical wall 196 of the upper trim section moves along the lower trim section 180 to provide a continuous, smooth appearance for the lower trim 24. Unlike the embodiment shown in FIGS. 5 and 6, the upper trim section 190 moves with the wall panel while the lower trim section 180 is stationary.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A demountable modular wall system for use in a building having a floor and a ceiling, comprising:

a series of individual glass panels each having a first side, a second side, a top end, a bottom end and a pair of vertical side edges, wherein at least two glass panels are positioned adjacent to each other and extend between the floor and the ceiling such that the pair of vertical side edges of the at least two adjacent glass panels are positioned adjacent each other to define a panel joint that extends between the floor and the ceiling;

a pair of separate stiffening channels each mounted to and configured to receive one of the adjacent vertical side edges of the at least two glass panels that define the panel joint, wherein each of the pair of stiffening channels is formed from a metallic material;

a pair of separate mounting brackets each positioned to span across the entirety of the panel joint between the at least two adjacent glass panels, wherein a first mounting bracket spans across the entirety of the panel joint on the first side of the at least two glass panels and a second mounting bracket spans across the entirety of the panel joint on the second side of the at least two glass panels;

at least one fastener comprising a first fastener that extends through the panel joint to engage both of the pair of mounting brackets to directly join the pair of mounting brackets to each other; and a vertical trim section coupled to each of the pair of mounting brackets to conceal the entirety of the mounting bracket and the panel joint.

2. The demountable modular wall system of claim 1 wherein the vertical trim section is held in place along the pair of mounting brackets by a friction fit.

3. The demountable modular wall system of claim 1 wherein each of the individual glass panels has a thickness of approximately ¼ inch.

4. The demountable modular wall system of claim 1 wherein each of the pair of stiffening channels are attached to the at least two glass panels by an adhesive.

5. A demountable modular wall system for use in a building having a floor and a ceiling, comprising:

a series of individual glass panels each having a top end and a bottom end;

a panel height adjustment mechanism positioned between the bottom end of each glass panel of the series of individual glass panels and a floor channel mounted to the floor to selectively adjust a vertical height of each glass panel of the series of individual glass panels from the floor;

a lower trim mounted to the floor channel and positioned between the bottom end of each glass panel of the series of individual glass panels and the floor, the lower trim including a pair of resilient lower wipers that are formed separate from and received in a horizontal portion of the lower trim that each flex relative to the lower trim and contact an outer face of the glass panel, wherein the lower trim is stationary such that each glass panel of the series of individual glass panels moves vertically relative to the lower trim; and an upper trim positioned between the top end of each glass panel of the series of individual glass panels and the ceiling, the upper trim including a pair of resilient upper wipers that are formed separate from and received in a horizontal portion of the upper trim that each flex relative to the upper trim and contact one of the outer faces of the glass panel, wherein the upper trim is stationary relative to the glass panel and mounted to a stationary ceiling channel that is stationary relative to the upper trim, wherein the upper trim receives the top end of the glass panel such that the top end of each glass panel of the series of individual glass panels is movable vertically relative to the stationary upper trim, wherein the width of both the lower trim and the upper trim remain constant during vertical movement of the glass panel.

6. The demountable modular wall system of claim 5 wherein the panel height adjustment mechanism is a pair of double jack screws each including a stationary threaded stud fixed to the floor and an upper jack screw that receives the threaded stud and is received in a mounting bracket attached to the bottom end of each glass panel of the series of individual glass panels.

7. The demountable modular wall system of claim 5 further comprising a stiffening channel mounted to side edges of each of the glass panels of the series of individual glass panels, wherein each of the stiffening channels is formed from a metallic material.

* * * * *